US006286182B1

(12) United States Patent
Mulder et al.

(10) Patent No.: US 6,286,182 B1
(45) Date of Patent: Sep. 11, 2001

(54) VACUUM CLEANER COMPRISING A HOLDER FOR ACCESSORIES

(75) Inventors: Roelf Mulder, Drachten; Benjamin L. Oudman, Hoogeveen; Paulus H. Van Wolferen, Hoogeveen; Jan Dorgelo, Hoogeveen, all of (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/498,885

(22) Filed: Feb. 7, 2000

(30) Foreign Application Priority Data

Feb. 12, 1999 (EP) ..... 99200408

(51) Int. Cl.[7] ..... A47L 9/00; A47L 9/32
(52) U.S. Cl. ..... 15/323; 15/410
(58) Field of Search ..... 15/323, 410

(56) References Cited

U.S. PATENT DOCUMENTS 3,872,538 * 3/1975 Crouser ..... 15/323
4,720,890 * 1/1988 Jacob ..... 15/410 X
5,732,438 * 3/1998 Tuvin et al. ..... 15/410 X
5,826,299 * 10/1998 Kim ..... 15/323

FOREIGN PATENT DOCUMENTS

13656 * 7/1934 (AU) ..... 15/323
0747000B1 12/1996 (EP) .

* cited by examiner

*Primary Examiner*—Chris K. Moore
(74) *Attorney, Agent, or Firm*—Ernestine C. Bartlett

(57) ABSTRACT

The invention relates to a vacuum cleaner comprising a housing (1) accommodating a suction unit (7). The vacuum cleaner comprises a suction nozzle (9) which can be coupled to the housing via a suction tube (13) and a suction hose (15). The vacuum cleaner further comprises a handle (17), which is present near a coupling (69) between the suction hose and the suction tube, and a holder (25) for accessories (27, 29), which is detachably coupled to the handle and fits over the handle near a first end (37) and near a second end (39).

According to the invention, the holder (25) comprises a bridge portion (41) interconnecting the first end (37) and the second end (39) of the holder, and the holder is detachably coupled to the handle (17) exclusively by means of a coupling member (51) which is present on a portion (53) of the bridge portion which is situated at a distance from the first end and the second end. Thus, the holder can be released from the handle and the holder can be coupled to the handle in a simple manner without much effort. During operation, the user holds the handle and the bridge together, thus preventing the holder from being unintentionally uncoupled from the handle under the influence of, for example, handling forces.

In a preferred embodiment, the handle (17) is a tube, while the bridge portion (41) comprises a shell-like portion (41) which is present at least near the first end (37) and near the second end (39), and which partially fits over the handle substantially without clearance. Thus, the holder (25) is secured against torsional movement around the coupling member (51) when it is coupled to the handle.

14 Claims, 3 Drawing Sheets

VACUUM CLEANER COMPRISING A HOLDER FOR ACCESSORIES

BACKGROUND OF THE INVENTION

The invention relates to a vacuum cleaner comprising a housing, which accommodates a suction unit, a suction accessory, which can be coupled to the housing via a suction hose and a suction tube, a handle, which is situated near a coupling between the suction hose and the suction tube, and a holder for further accessories, which is detachably coupled to the handle and connects to said handle near a first end and a second end.

The invention also relates to a holder which can suitably be used in a vacuum cleaner in accordance with the invention.

The invention further relates to a suction hose which can suitably be used in a vacuum cleaner in accordance with the invention, said suction hose comprising the handle of the vacuum cleaner.

The invention additionally relates to a suction tube which can suitably be used in a vacuum cleaner in accordance with the invention, said suction tube comprising the handle of the vacuum cleaner.

A vacuum cleaner of the type mentioned in the opening paragraph is disclosed in EP-B-0 747 000. The handle of the known vacuum cleaner is tubular and forms part of a suction duct of the vacuum cleaner which connects the suction accessory to the suction unit. The holder of the known vacuum cleaner is plate-shaped and extends parallel to the handle in a state wherein the holder is coupled to the handle. A number of further accessories of the vacuum cleaner are detachably coupled to the holder. Since the holder is in the immediate vicinity of the handle, a user of the vacuum cleaner has said accessories close at hand, resulting in a high ease of use. Since the holder connects to the handle only near the two ends of the holder, a relatively large gripping space for the handle is provided between the handle and the holder, so that upon gripping the handle, the user is not hampered by the holder. The known holder comprises, at each of the two ends, a coupling member for coupling the holder to the handle. As a result, a stable coupling of the holder to the handle is achieved.

A drawback of the known vacuum cleaner resides in that uncoupling the holder requires both the first end and the second end of the holder to be uncoupled from the handle, while coupling the holder to the handle requires both the first end of the holder and the second end of the holder to be coupled to the handle. Consequently, coupling and uncoupling of the holder is rather inconvenient to the user. A further drawback of the known vacuum cleaner resides in that the forces exerted on the holder during detaching an accessory from the holder may unintentionally cause the entire holder to be uncoupled from the handle.

SUMMARY OF THE INVENTION

It is an object of the invention to provide a vacuum cleaner of the type mentioned in the opening paragraph, wherein the above-mentioned drawbacks of the known vacuum cleaner are precluded as much as possible.

In order to achieve said object, the vacuum cleaner in accordance with the invention is characterized in that the holder is provided with a bridge which interconnects both ends of the holder, which holder can be coupled to the handle exclusively by means of a coupling member which is provided on a part of the bridge which is situated at a distance from both ends. As a result of the fact that the holder can be coupled to the handle exclusively by means of the coupling member provided on said part of the bridge, coupling and uncoupling of the holder is considerably simplified. In common with the vacuum cleaner described in EP-B-0 747 000. the holder of the vacuum cleaner in accordance with the invention connects with both ends to the handle, so that the vacuum cleaner in accordance with the invention also has a relatively large gripping space for the handle. In the case of the vacuum cleaner in accordance with the invention, said gripping space is situated between the holder and the bridge interconnecting both ends of the holder. As a result, the user gripping the handle also grips the bridge of the holder, so that, during operation, the holder cannot separate from the handle if the holder were to be unintentionally uncoupled from the handle, or if forces were to be exerted on the holder during detaching accessories from the holder.

It is noted that in the foregoing and the following parts of this document as well as in the claims, the expression "connect to" is to be taken to mean "fit on without, or substantially without, interspace". Thus, said expression is not to be taken to include "coupled to or connected to".

A particular embodiment of a vacuum cleaner in accordance with the invention is characterized in that the handle is tubular, while the bridge comprises a shell-shaped part at least near the two ends of the holder, which shell-shaped part partly fits over the tubular handle substantially without clearance. By virtue of the fact that the bridge is provided with said shell-shaped part near both ends of the holder, the holder is secured against torsional movements about the coupling member in an effective and robust manner. It is thus precluded that, under the influence of such torsional movements, the holder is unintentionally uncoupled from the handle and that the coupling member is distorted under the influence of such torsional movements.

A further embodiment of a vacuum cleaner in accordance with the invention is characterized in that the bridge comprises a single shell-shaped part which extends from the first end to the second end of the holder and partly fits over the tubular handle substantially without clearance. Due to the fact that the bridge comprises said single shell-shaped part, a simple construction of the holder is obtained and the handle with the bridge coupled thereto handles nicely.

Yet another embodiment of a vacuum cleaner in accordance with the invention is characterized in that the handle and the bridge are curved, viewed in a longitudinal direction of the handle. Said curved shape of the handle and the bridge, viewed in the longitudinal direction of the handle, provides for a relatively large space between the holder and the bridge and hence a relatively large gripping space for the handle.

A particular embodiment of a vacuum cleaner in accordance with the invention is characterized in that the handle and the bridge are provided with co-operating locking elements by means of which the holder can be locked with respect to the handle, viewed in a longitudinal direction of the handle. By using said locking elements, it is precluded, in a practical and simple manner, that the holder can be moved along the handle in the longitudinal direction under the influence of handling forces when the holder is in the coupled situation.

A further embodiment of a vacuum cleaner in accordance with the invention is characterized in that the coupling member comprises two elastically deformable hooks for cooperation with a coupling element of the handle which, viewed in cross-section, is T-shaped. In this manner, a simple construction, a reliable operation and a simple control of the coupling member is obtained. Uncoupling of the holder takes place by simply snapping the holder from the handle, while elastically deforming said hooks, and coupling of the holder to the handle takes place by simply snapping the holder onto the handle while elastically deforming said hooks.

Yet another embodiment of a vacuum cleaner in accordance with the invention is characterized in that the coupling element comprises a central part for co-operation with the hooks of the holder, and the coupling element is provided, on either side of the central part, with parts which are widened with respect to the central part. In this embodiment, the hooks and said widened parts of the coupling element form the above-mentioned co-operating locking elements by means of which shifting of the holder along the handle in the longitudinal direction is precluded. In this manner, reliably operating locking elements are obtained in a simple manner.

BRIEF DESCRIPTION OF THE DRAWINGS

These and other aspects of the invention will be apparent from and elucidated with reference to the embodiments described hereinafter.

In the drawings.

DESCRIPTION OF THE PREFERRED EMBODIMENTS

Figure 1:
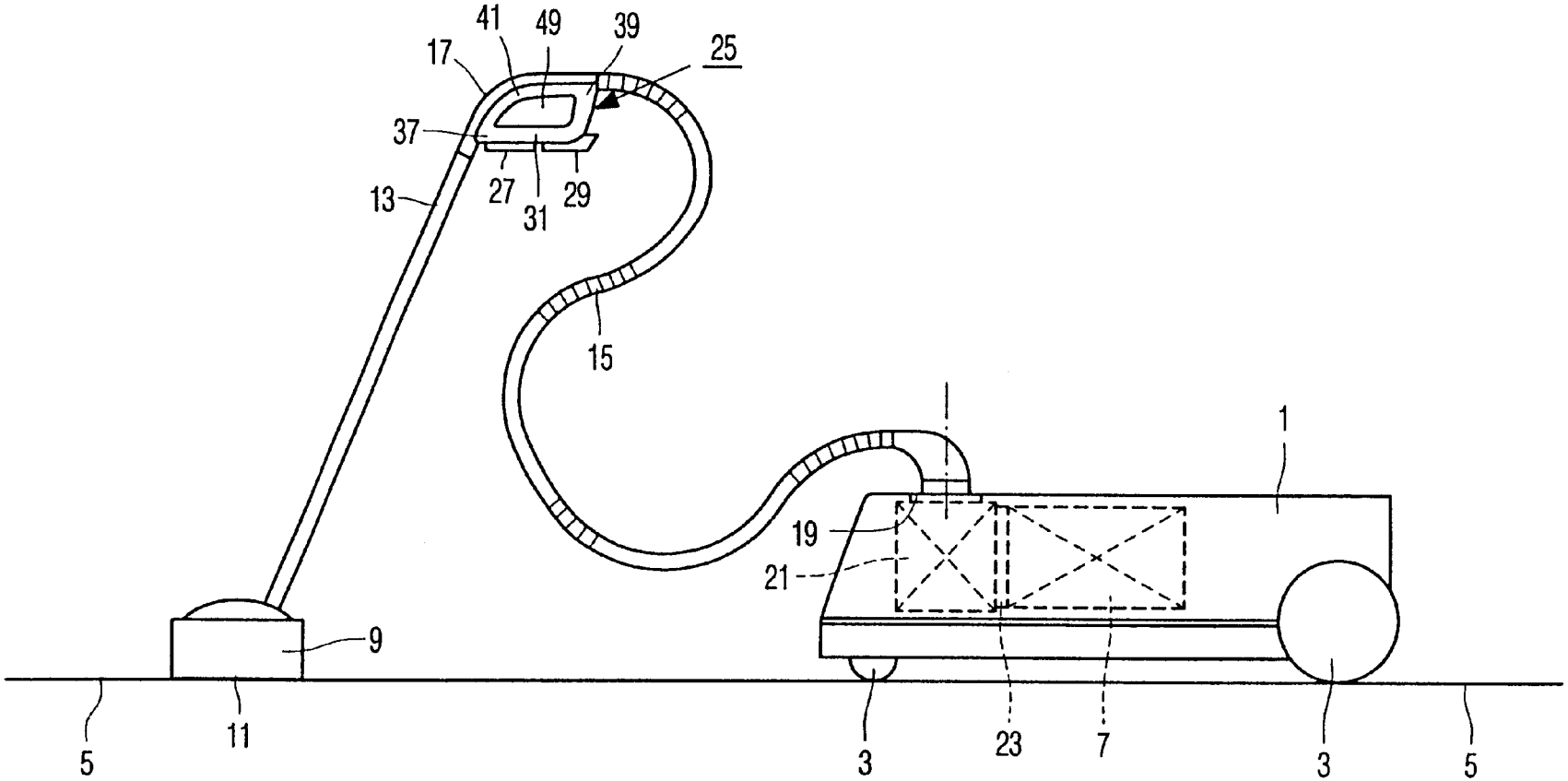
FIG. 1 diagrammatically shows a vacuum cleaner in accordance with the invention.

The vacuum cleaner in accordance with the invention, as shown in FIG. 1, is a so-called canister-type vacuum cleaner which comprises a housing 1 which can be moved over a surface 5 to be cleaned by means of a number of wheels 3. The housing 1 accommodates an electrical suction unit 7 which is only diagrammatically shown in FIG. 1. The vacuum cleaner further comprises a suction accessory 9 which, in the example shown, has a suction nozzle 11. The suction accessory 9 is detachably coupled to the housing 1 via a metal suction tube 13 and a flexible suction hose 15, said suction accessory 9 being pivotably coupled to the suction tube 13, the suction tube 13 being detachably coupled to a tubular handle 17 secured to the suction hose 15, and the suction hose 15 being detachably coupled to an input 19 of the housing 1. The input 19 opens into a dust chamber 21 of the housing 1 which is connected to the suction unit 7 via a filter 23. In operation, the suction unit 7 creates a partial vacuum in a suction duct which comprises, in succession, the suction accessory 9, the suction tube 13, the handle 17, the suction hose 15, the input 19 and the dust chamber 21 of the vacuum cleaner. Under the influence of said partial vacuum, dust and dirt particles present on the surface 5 to be cleaned are sucked via the suction nozzle 11 of the suction accessory 9 and said suction duct towards the dust chamber 21 where they are collected in a disposable dust bag.

Figure 2:
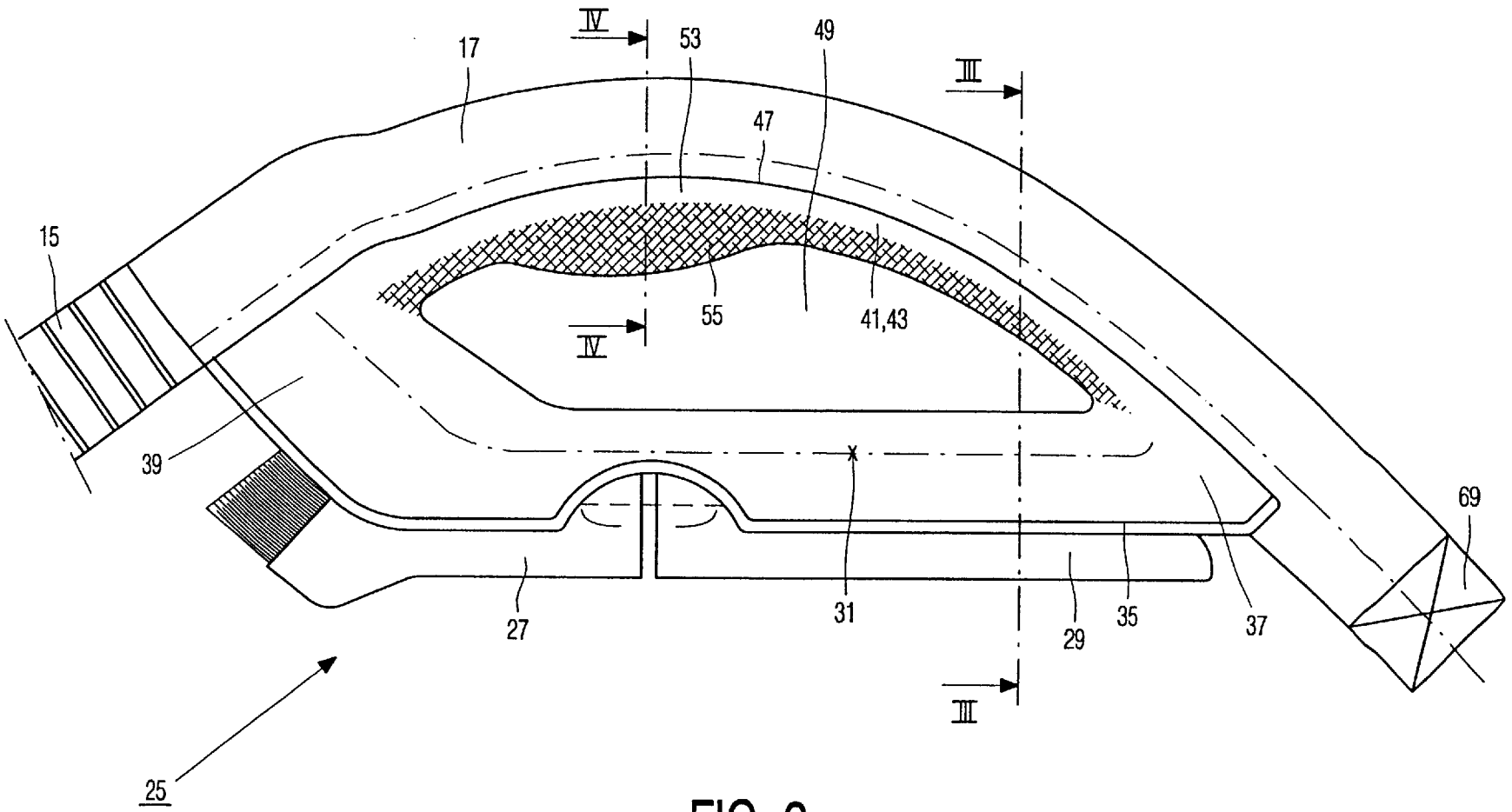
FIG. 2 shows a handle with a detachably coupled holder of the vacuum cleaner in accordance with FIG. 1.
Figure 3:
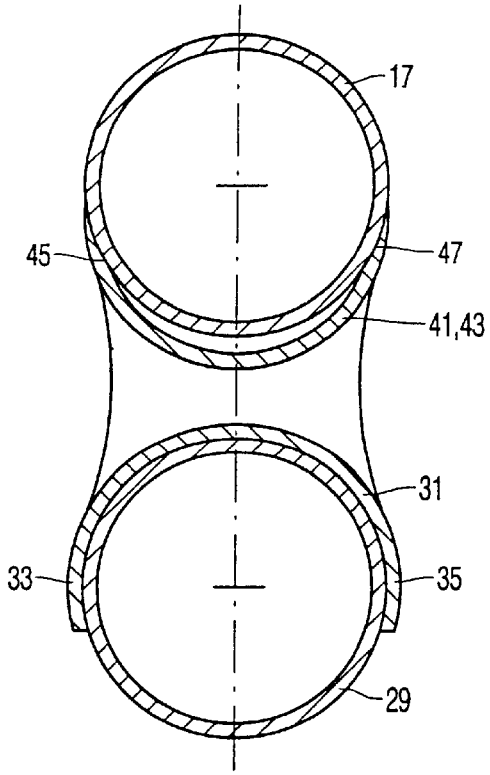
FIG. 3 is a sectional view taken on the line III—III in FIG. 2.

As FIG. 1 further shows, the vacuum cleaner is provided with a synthetic resin holder 25 to which a number of further accessories 27, 29 of the vacuum cleaner are detachably attached, such as a number of alternative suction accessories which can be used instead of the suction accessory 9 to clean, for example, furniture. The holder 25 is detachably coupled to the handle 17 in a manner which will be described in greater detail hereinafter, and the holder is shown in detail in FIG. 2. As shown in FIG. 2, the holder 25 comprises a clamping member 31 which extends substantially parallel to the tubular handle 17. As shown in FIG. 3, the clamping member 31 has a C-shaped cross-section with two elastically deformable hooks 33, 35 between which the accessories 27, 29 can be clamped. The clamping member 31 of the holder 25 connects to the handle 17 close to a first end 37 and close to a second end 39, said two ends 37 and 39 being interconnected by a bridge 41 forming part of the holder 25. As shown in FIG. 3, the bridge 41 includes a shell-shaped part 43 having a cross-section which is slightly shorter than a half ring. The shell-shaped part 43 extends throughout the holder 25, i.e. throughout the first end 37 of the holder 25, throughout the bridge 41 and throughout the second end 39 of the holder 25. As is also shown in FIG. 3, the shell-shaped part 43 fits partly over the tubular handle 17, viewed throughout the length of the holder 25, both edges 45 and 47 of the shell-shaped part 43 engaging the handle 17 almost without clearance.

Due to the fact that the holder 25 is situated in the immediate vicinity of the handle 17, a user of the vacuum cleaner has the accessories 27, 29 close at hand, so that a great ease of use is provided. Since the clamping member 31 connects with both ends 37 and 39 to the handle 17, and the two ends 37 and 39 are interconnected by the bridge 41, a large gripping space 49 is provided between the clamping member 31 and the bridge 41, in which gripping space the user can place a hand to grip the handle 17. When the user grips the handle 17 via the gripping space 49, he is not hampered by the clamping member 31 with the further accessories 27, 29, so that said construction of the holder 25 provides a great ease of use. As shown in FIG. 2, the tubular handle 17 and the bridge 41 are curved, viewed in a longitudinal direction of the handle 17, so that the gripping space 49 is further increased. By using the bridge 41, a rigid and stable construction of the holder 25 is obtained. Since the bridge 41 comprises said shell-shaped part 43, the handle 17 and the bridge 41 handle nicely. When the user grips the handle 17, he also grips the bridge 41 of the holder 25, so that, during operation, the holder 25 cannot fall from the handle 17 if the holder 25 were to be unintentionally uncoupled from the handle 17, or if forces were to be exerted on the holder 25 during detaching the accessories 27, 29.

Figure 4:
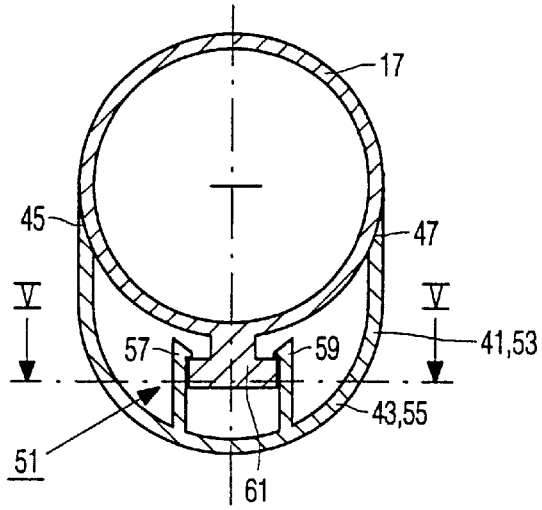
FIG. 4 is a sectional view taken on the line IV—IV in FIG. 2.
Figure 5:
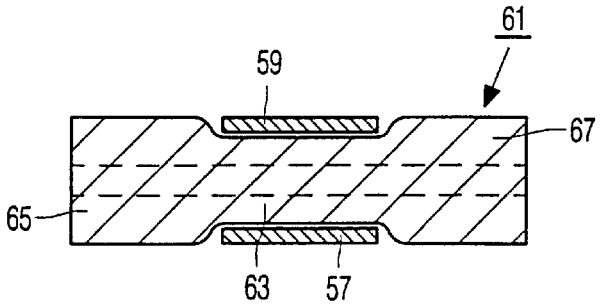
FIG. 5 is a sectional view taken on the line V—V in FIG. 4.

In accordance with the invention, the holder 25 is detachably coupled to the handle 17 exclusively by means of a coupling member 51 which is provided on a part 53 of the bridge 41 which is situated at a distance from both ends 37 and 39. In the example shown in FIG. 2, said part 53 of the bridge 41 is closer to the second end 39 than to the first end 37. In accordance with the invention, said part 53 of the bridge 41 may alternatively be situated centrally between the two ends 37 and 39, or closer to the first end 37 than to the second end 39. As shown in FIG. 2, the coupling member 51 is situated in an enlarged part 55 of the shell-shaped part 43 of the bridge 41, and is shown in section in FIG. 4. As shown in FIG. 4, the coupling member 51 comprises two elastically deformable hooks 57, 59 which are integrated with the shell-shaped part 43 of the bridge 41. In the coupled state, the hooks co-operate with a coupling element 61, which is integrated with the handle 17, and, as shown in FIG. 4, is T-shaped in cross-section. The coupling element 61 extends in the longitudinal direction of the tubular handle 17 and comprises, as shown in FIG. 5, a central part 63 for co-operation with the hooks 57, 59 of the coupling member 51. On either side of the central part 63, the coupling element 61 is provided with parts 65 and 67 which are widened with respect to the central part 63. Since the holder 25 is detachably coupled to the handle 17 exclusively by means of the coupling member 51, the holder 25 can be simply and quickly uncoupled from and coupled to the handle 17. The coupling member 51 and the coupling element 61 are constructed in a simple, robust manner and operate reliably. The holder 25 is uncoupled by simply pulling it from the handle 17, whereby the hooks 57, 59 are elastically deformed. The holder 25 is coupled to the handle 17 by simply snapping it onto the handle 17, which also involves deformation of the hooks 57, 59. Since the coupling element 61 is provided with the parts 65, 67, which are widened with respect to the central part 63, the holder 25 can be coupled to the handle 17 exclusively in a position where the hooks 57, 59 embrace the central part 63. This is a simple way of accurately positioning the holder 25 with respect to the handle 17. In addition, the parts 65, 67, which are widened with respect to the central part 63, also preclude in a simple and reliable manner that, during use, the holder 25 can be moved in the longitudinal direction of the handle 17 as a result of, for example, handling forces. The hooks 57, 59 and the widened parts 65, 67 thus form co-operating locking elements by means of which the holder 25 can be locked with respect to the handle 17, viewed in the longitudinal direction of the handle 17.

It is noted that, at the location of the ends 37 and 39, the holder 25 is not coupled to the handle 17 but only connects to the handle 17, i.e. it fits on the handle 17 substantially without clearance and engages the handle 17 with the two edges 45, 47. Since the cross-section of the shell-shaped part 43 of the bridge is slightly shorter than a half ring, the shell-shaped part 43 is not coupled to the handle 17 near the ends 37 and 39, and the shell-shaped part 43 causes no resistance near the ends 37 and 39 upon uncoupling and removing the holder 25. Since the shell-shaped part 43 extends to a point proximate to the first end 37 and the second end 39, the holder 25 is secured against torsional movements about the coupling member 51 in an efficacious and robust manner. The shell-shaped part 43 thus precludes that the holder 25 can be unintentionally uncoupled from the handle 17 under the influence of such torsional movements, and that the coupling member 51 can be distorted or damaged under the influence of such torsional movements. It is noted that such securing of the holder 25 with respect to the handle 17 is also achieved in an alternative embodiment of the vacuum cleaner in accordance with the invention, wherein the bridge 41 of the holder 25 comprises a shell-shaped part exclusively near the two ends 37 and 39, which shell-shaped part partly fits over the tubular handle 17 substantially without clearance, and wherein the bridge 41 between the two ends 37 and 39 has a different shape or, for example, is recessed in the handle 17.

In the above-described example of the vacuum cleaner in accordance with the invention, the handle 17 is permanently secured to the suction hose 15, and the handle 17 comprises a coupling 69, only diagrammatically shown in FIG. 2, with which the handle 17 can be detachably coupled to the suction tube 13. The suction hose 15, the handle 17 secured to the suction hose 15, and the holder 25 which is detachably coupled to the handle 17 thus constitute a separate part of the vacuum cleaner. It is noted that the invention also includes vacuum cleaners wherein the handle and the holder for further accessories, which is detachably coupled to said handle, are permanently secured to the suction tube, said handle comprising a coupling with which the handle can be detachably coupled to the suction hose. The invention also includes vacuum cleaners wherein the handle and the holder for further accessories, which is detachably coupled to said handle, includes two couplings with which the handle can be detachably coupled to, respectively, the suction hose and the suction tube.

It is further noted that instead of the coupling member 51, another type of coupling member may alternatively be used which is provided on the central part 53 of the bridge 41. For example, instead of the coupling member 51, a central part of the shell-shaped part 43 can be used as the coupling member, in which case the relevant central part of the shell-shaped part 43 has a slightly longer cross-section than a half ring, so that the central part of the shell-shaped part 43 can be made to embrace the tubular handle 17, while being subject to elastic deformation. In addition, instead of the coupling member 51, use can be made, for example, of a coupling member which is provided with a locking slide which is slidably mounted in the shell-shaped part 43 and which co-operates with a locking element provided on the handle 17, said locking slide being slidable against the pretension of a mechanical spring by pushing in at least one operating knob provided on the holder. Other variations may relate to, for example, a pair of wire springs secured in the shell-shaped part which co-operate with a T-shaped coupling element of the handle, which wire springs can be pressed apart, leading to elastic deformation of the wire springs and to the release of the coupling element, by shifting a slide knob arranged between the two wire springs. Instead of the coupling member 51 and the coupling element 61, in addition, other types of co-operating clamping members can be used which are customary per se, such as a projection for co-operation with a clamping groove. It is further noted that the central part 53 of the bridge 41 in accordance with the invention can also be provided with more than one coupling member for coupling the holder 25 to the handle 17.

In the example of a vacuum cleaner in accordance with the invention, as described hereinabove, the hooks 57, 59 of the coupling member 51 and the coupling element 61 also form co-operating locking elements for precluding movements of the holder 25 along the handle 17 in the longitudinal direction. Finally, it is noted that the handle 17 and the holder 25 in accordance with the invention may also be provided with separate locking elements for precluding such movements.

What is claimed is:

1. A vacuum cleaner comprising a housing, which accommodates a suction unit, a suction accessory, which can be coupled to the housing via a suction hose and a suction tube, a handle, which is situated near a coupling between the suction hose and the suction tube, and a holder for further accessories, which holder comprises a first end and a second end and is detachably coupled to the handle via a coupling member, wherein the holder is provided with a bridge which interconnects both ends of the holder, which holder is capable of being coupled to the handle exclusively by means of a coupling member provided on a part of the bridge which is situated at a distance from both ends.

2. A vacuum cleaner as claimed in claim 1, wherein the handle is tubular, and the bridge comprises a shell-shaped part at least near the two ends of the holder, which shell-shaped part partly fits over the tubular handle substantially without clearance.

3. A vacuum cleaner as claimed in claim 2, wherein the bridge is a single shell-shaped part that extends from the first end to the second end of the holder and partly fits over the tubular handle substantially without clearance.

4. A vacuum cleaner as claimed in claim 1, wherein the handle and the bridge are curved, viewed in a longitudinal direction of the handle.

5. A vacuum cleaner as claimed in claim 1, wherein the coupling member, the handle and the bridge are provided with co-operating locking elements by means of which the holder can be locked with respect to the handle, viewed in a longitudinal direction of the handle.

6. A vacuum cleaner as claimed in claim 1, wherein the coupling member comprises two elastically deformable hooks for co-operation with a coupling element of the handle which, viewed in cross-section, is T-shaped.

7. A vacuum cleaner as claimed in claim 6, wherein the coupling element comprises a central part for co-operation with the hooks of the holder, and the coupling element is provided, on either side of the central part, with parts which are widened with respect to the central part.

8. A holder for use in a vacuum cleaner, which holder comprises a first end and a second end and is detachably attached to a handle of the vacuum cleaner near the first end and the second end via a coupling member, wherein the holder is provided with a bridge which interconnects both ends of the holder, which holder is capable of being coupled to the handle of the vacuum cleaner exclusively by means of a coupling member provided on a part of the bridge which is situated at a distance from both ends.

9. A holder as claimed in claim 8, wherein the handle is tubular and the bridge comprises a shell-shaped part at least near the two ends of the holder, which shell-shaped part partly fits over the tubular handle substantially without clearance.

10. A holder as claimed in claim 9, wherein the bridge is a single shell-shaped part that extends from the first end to the second end of the holder and partly fits over the tubular handle substantially without clearance.

11. A holder as claimed in claim 8, wherein the handle and the bridge are curved, viewed in a longitudinal direction of the handle.

12. A holder as claimed in claim 8, wherein the coupling member, the handle and the bridge are provided with co-operating locking elements by means of which the holder can be locked with respect to the handle, viewed in a longitudinal direction of the handle.

13. A holder as claimed in claim 8, wherein the coupling member comprises two elastically deformable hooks for co-operation with a coupling element of the handle which, viewed in cross-section, is T-shaped.

14. A holder as claimed in claim 13, wherein the coupling element comprises a central part for co-operation with the hooks of the holder, and the coupling element is provided, on either side of the central part, with parts which are widened with respect to the central part.

* * * * *